US011320210B2

(12) United States Patent
Machida

(10) Patent No.: US 11,320,210 B2
(45) Date of Patent: May 3, 2022

(54) LOOP HEAT PIPE WHERE POROUS BODY IS IN CONTACT WITH PIPE WALL OF LIQUID PIPE

(71) Applicant: SHINKO ELECTRIC INDUSTRIES CO., LTD., Nagano (JP)

(72) Inventor: Yoshihiro Machida, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 211 days.

(21) Appl. No.: 16/502,370

(22) Filed: Jul. 3, 2019

(65) Prior Publication Data

US 2020/0018556 A1 Jan. 16, 2020

(51) Int. Cl.

| | |
|---|---|
| ***F28D 15/02*** | (2006.01) |
| ***F28D 15/04*** | (2006.01) |
| *F28D 21/00* | (2006.01) |

(52) U.S. Cl.

CPC ..... *F28D 15/0266* (2013.01); *F28D 15/0283* (2013.01); *F28D 15/04* (2013.01); *F28D 2021/0028* (2013.01)

(58) Field of Classification Search

CPC .... F28D 15/0266; F28D 15/043; F28D 15/04; F28D 15/0283

See application file for complete search history.

(56) References Cited

U.S. PATENT DOCUMENTS

| | | | | |
|---|---|---|---|---|
| 6,843,308 | B1 * | 1/2005 | Duval | F28D 15/0233 165/104.26 |
| 6,892,799 | B2 * | 5/2005 | Maydanik | F28D 15/043 165/104.26 |
| 2004/0069459 | A1 * | 4/2004 | Tonosaki | H01L 23/427 165/104.25 |
| 2006/0144567 | A1 * | 7/2006 | Zhu | F28D 15/0266 165/104.29 |

(Continued)

FOREIGN PATENT DOCUMENTS

| | | |
|---|---|---|
| CN | 108225072 | 6/2018 |
| EP | 3299758 A1 | 3/2018 |

(Continued)

OTHER PUBLICATIONS

Translation of JP2015183880A entitled Translation-JP2015183880A (Year: 2021).*

(Continued)

*Primary Examiner* — Paul Alvare

(74) *Attorney, Agent, or Firm* — Rankin, Hill & Clark LLP

(57) ABSTRACT

A loop heat pipe includes: an evaporator configured to evaporate working fluid; a condenser configured to condense the working fluid; a liquid pipe which connects the evaporator and the condenser and has a first pipe wall and a second pipe wall which is opposed to the first pipe wall; a porous body which is provided in the liquid pipe and is configured to guide the working fluid condensed by the condenser to the evaporator; a flow channel which is a space that is formed (Continued)

in the liquid pipe and guides the working fluid condensed by the condenser to the evaporator; and a vapor pipe which connects the evaporator and the condenser and forms a loop together with the liquid pipe. The porous body is disposed to be in contact with the first pipe wall.

11 Claims, 14 Drawing Sheets

(56) References Cited

U.S. PATENT DOCUMENTS

2006/0173344 A1* 8/2006 Marian ..... F28D 15/00 600/459
2006/0185827 A1* 8/2006 Huang ..... F28D 15/0275 165/104.25
2006/0262505 A1* 11/2006 Cheng ..... G06F 1/20 361/700
2008/0078530 A1 4/2008 Chang et al.
2011/0000647 A1* 1/2011 Hou ..... F28D 15/043 165/104.26
2012/0043059 A1* 2/2012 Xu ..... F28D 15/0266 165/104.26
2016/0047605 A1* 2/2016 Mishkinis ..... F28D 15/043 165/104.25
2016/0259383 A1* 9/2016 Shioga ..... G06F 1/203
2016/0330874 A1* 11/2016 Sato ..... F28D 15/06
2018/0063994 A1* 3/2018 Wu ..... H05K 7/20309
2018/0142960 A1 5/2018 Kurashima et al.
2018/0164043 A1 6/2018 Kurashima et al.
2018/0177077 A1* 6/2018 Shioga ..... F28D 15/0266
2019/0090386 A1* 3/2019 Shioga ..... H01L 23/427
2019/0277574 A1 9/2019 Kurashima et al.

FOREIGN PATENT DOCUMENTS

JP 2015183880 A * 10/2015
JP 6146484 5/2017

OTHER PUBLICATIONS

European Search Report dated Dec. 5, 2019, 7 pages.
Chinese Office Action dated Nov. 18, 2021, English translation included, 19 pages.

* cited by examiner 152
152x
152y
152z
153
153x
153y
153z
154
154x
154y
154z
155
155x
155y
155z
II
$W_3$
$L_1$
$W_4$
$L_2$
X
Y
Z

LOOP HEAT PIPE WHERE POROUS BODY IS IN CONTACT WITH PIPE WALL OF LIQUID PIPE

This application claims priority from Japanese Patent Applications No. 2018-131817, filed on Jul. 11, 2018, the entire contents of which are herein incorporated by reference.

BACKGROUND

1. Technical Field

The present disclosure relates to a loop heat pipe.

2. Background Art

Heat pipes are known as devices for cooling a heat generation component such as a CPU (central processing unit) that is installed in an electronic device. The heat pipe is a device that transports heat utilizing phase transition of a working fluid.

An example heat pipe is a loop heat pipe that is equipped with an evaporator that evaporates working fluid by heat generated by a heat generation component and a condenser that condenses evaporated working fluid by cooling it, and in which the evaporator and the condenser are connected to each other by a liquid pipe and a vapor pipe that form a loop-shaped flow channel. In loop heat pipes, the working fluid flows through a loop-shaped flow channel in one direction.

A porous body is provided in a liquid pipe of a loop heat pipe, and working fluid in the liquid pipe is guided to the evaporator by capillary forces generated in the porous body, whereby a reverse flow of vapor from the evaporator to the liquid pipe is suppressed. A number of pores are formed in the porous body. Pores are formed by laying, one on another, metal layers through each of which through-holes are formed in such a manner that adjacent through-holes overlap with each other. Refer to Japanese Patent No. 6,146,484, for example.

However, the loop heat pipe disclosed in Japanese Patent No. 6,146,484 has a problem that there may occur a case that it cannot attain sufficiently high heat transport performance.

SUMMARY

Certain embodiments provide a loop heat pipe.

The loop heat pipe comprises:

an evaporator configured to evaporate working fluid;

a condenser configured to condense the working fluid;

a liquid pipe which connects the evaporator and the condenser and has a first pipe wall and a second pipe wall which is opposed to the first pipe wall;

a porous body which is provided in the liquid pipe and is configured to guide the working fluid condensed by the condenser to the evaporator;

a flow channel which is a space that is formed in the liquid pipe and guides the working fluid condensed by the condenser to the evaporator; and a vapor pipe which connects the evaporator and the condenser and forms a loop together with the liquid pipe.

The porous body is disposed to be in contact with the first pipe wall.

DESCRIPTION OF EMBODIMENTS

The present inventors diligently studied to find a reason why there may occur a case that sufficiently high heat transport performance cannot be obtained. Detailed analyses of the inventors have found that air bubbles exist in a flow channel that should be filled with liquid-phase working fluid and obstruct flow of the liquid-phase working fluid. It has also been found that one reason of the above problem is a phenomenon that a porous body provided in a liquid pipe obstructs movement of working fluid in the liquid pipe during charging of working fluid. These new pieces of knowledge will be described below using a reference example.

Figure 1:
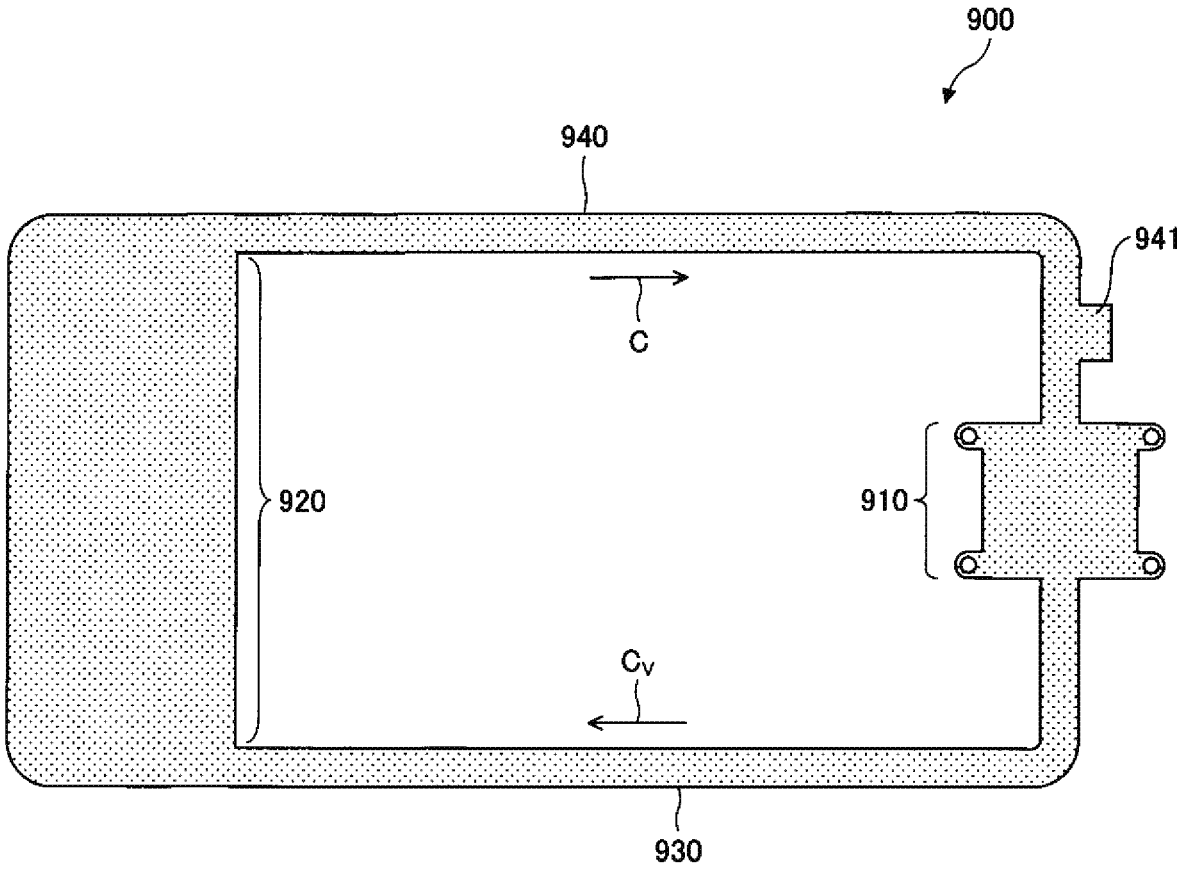
FIG. 1 is a schematic plan view of a loop heat pipe as a reference example.

FIG. 1 is a schematic plan view of a loop heat pipe as a reference example.

As shown in FIG. 1, a loop heat pipe 900 of the reference example is equipped with an evaporator 910, a condenser 920, a vapor pipe 930, and a liquid pipe 940.

In the loop heat pipe 900, the evaporator 910 is configured to generate vapor Cv by evaporating working fluid C. The condenser 920 is configured to condense the vapor Cv. The evaporator 910 and the condenser 920 are connected to each other by the vapor pipe 930 and the liquid pipe 940, and the vapor pipe 930 and the liquid pipe 940 form a flow channel that is a loop through which the working fluid C or the vapor Cv flows.

The liquid pipe 940 is formed with an injection inlet 941 through which working fluid C is injected. The injection inlet 941 is sealed after injection of working fluid C.

Figure 2A:
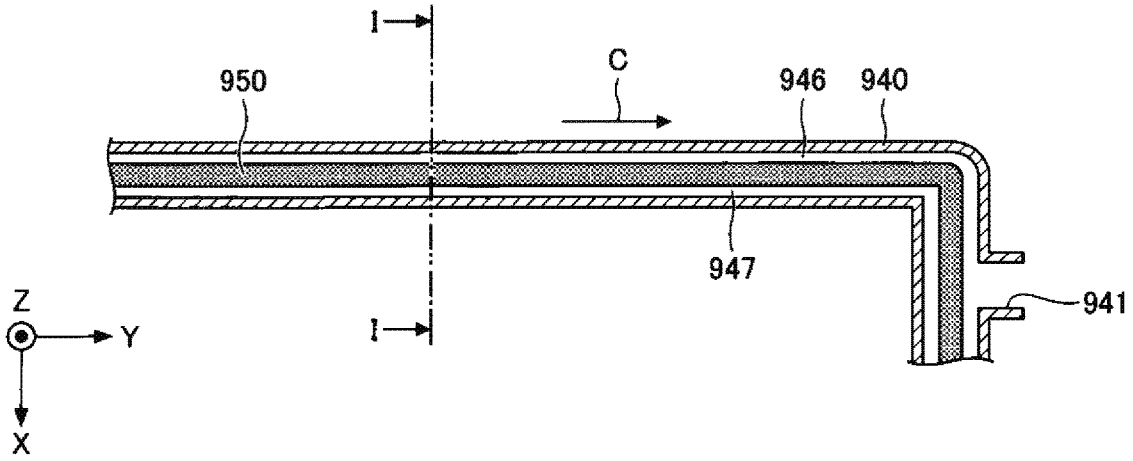
FIGS. 2A and 2B are a partial schematic plan view and a sectional view taken along line I-I in FIG. 2A, respectively, showing an example internal structure of a liquid pipe of the loop heat pipe as the reference example.
Figure 2B:
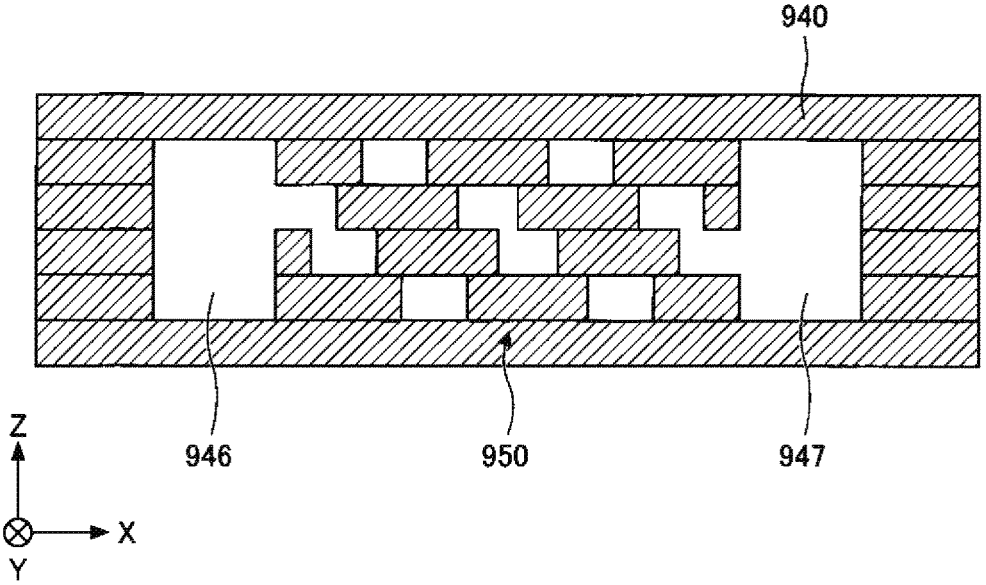

FIGS. 2A and 2B show an example inside structure of the liquid pipe 940 of the loop heat pipe as the reference example. FIG. 2A is a partial schematic plan view and FIG. 2B is a sectional view taken along line I-I in FIG. 2A. FIG. 2A is drawn in such a manner that the uppermost one of metal layers shown in FIG. 2B is omitted.

As shown in FIGS. 2A and 2B, a prop-like porous body 950 is disposed at the center, in a plan view, of the liquid pipe 940. The porous body 950 extends along the liquid pipe 940 from the condenser 920 to the evaporator 910, and the flow channel of the liquid pipe 940 is divided into two channels, that is, an outside flow channel 946 which is formed outside the porous body 950 and an inside flow channel 947 which is formed inside the porous body 950. The injection inlet 941 communicates with the outside flow channel 946.

Figure 3:
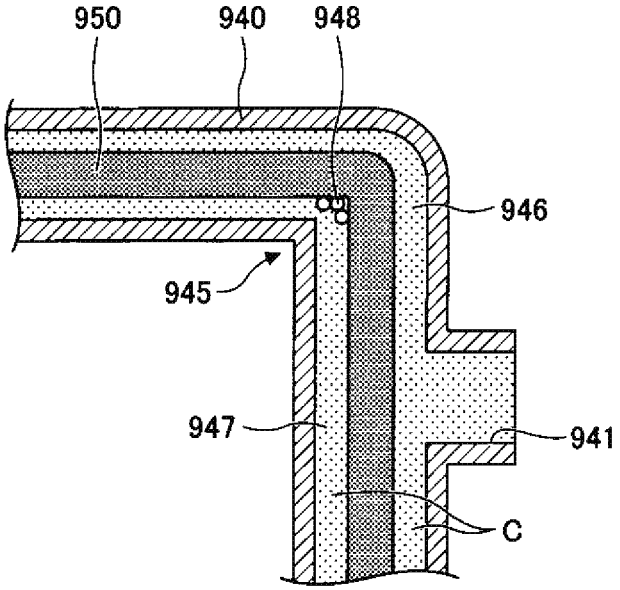
FIG. 3 is a partial schematic plan view showing part of the liquid pipe employed in the reference example and working fluid flowing through it.

Behavior of working fluid C that has been injected into the liquid pipe 940 employed in the reference example will be described below. FIG. 3 is a partial schematic plan view showing part of the liquid pipe 940 employed in the reference example and working fluid C flowing through it.

Liquid-phase working fluid C that has been injected into the liquid pipe 940 through the injection inlet 941 spreads over the outside flow channel 946 and the outside flow channel 946 is filled with working fluid C. Working fluid C also flows into the inside flow channel 947 while permeating through the porous body 950. However, since the porous body 950 obstructs movement of working fluid C to not a small extent, working fluid C flows into portions of the inside flow channel 947 discontinuously. As a result, air bubbles 948 are prone to remain in the inside flow channel 947, particularly in the vicinity of a bent portion 945 of the liquid pipe 940.

The air bubbles 948 existing in the liquid pipe 940 obstruct flow of liquid-phase working fluid C, possibly resulting in unexpected reduction in heat transport performance. Furthermore, the air bubbles 948 may cause the liquid pipe 940 to swell when the loop heat pipe 900 receives heat. Such swelling may lower the mechanical strength of the liquid pipe 940.

Embodiments of the invention will be hereinafter described in a specific manner with reference to the accompanying drawings. In this specification, constituent elements having substantially the same function and structure will be given the same reference symbol and a redundant description therefor may be omitted.

Embodiment 1

A first embodiment will be described below which relates to a loop heat pipe.

[Configuration of Loop Heat Pipe 100]

Figure 4:
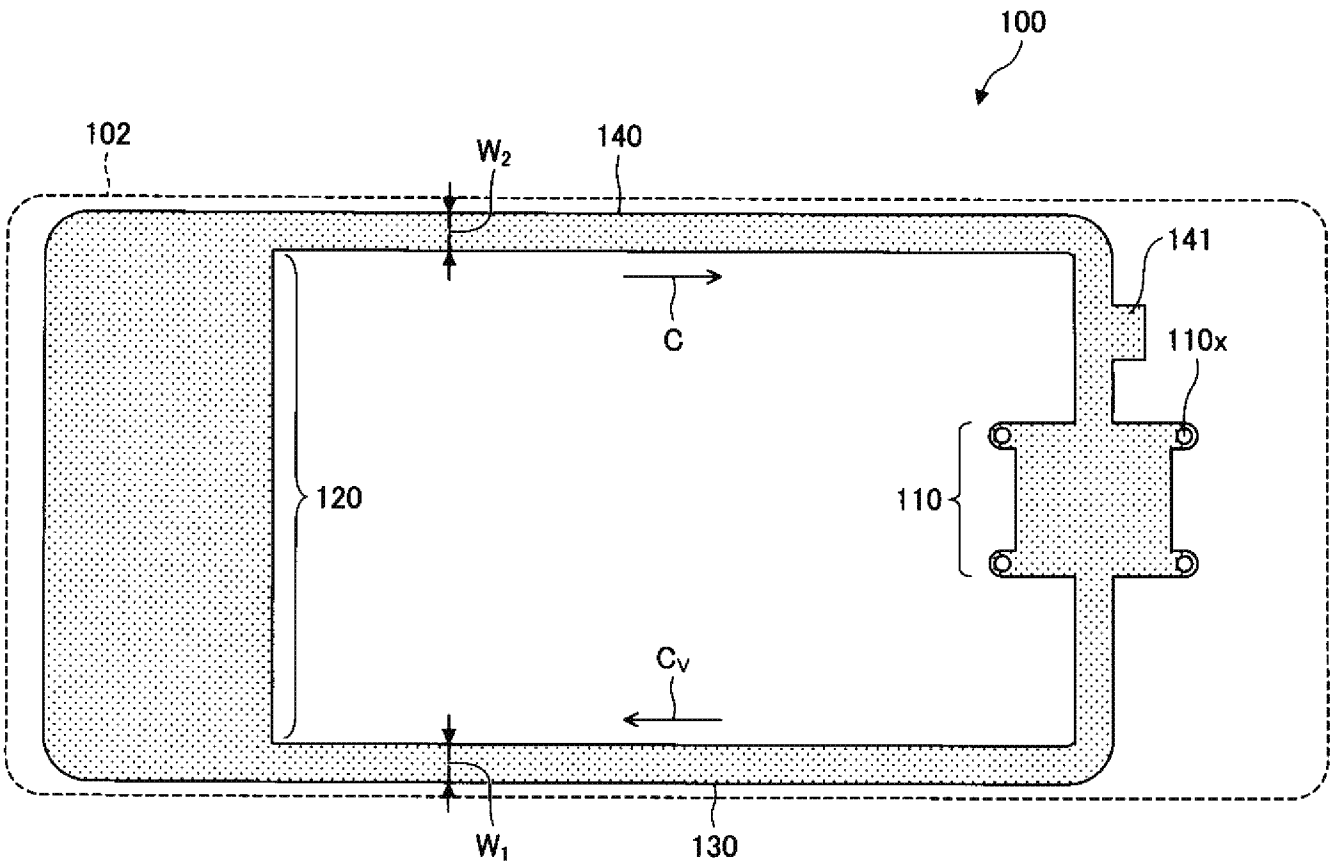
FIG. 4 is a schematic plan view showing a loop heat pipe according to a first embodiment.

FIG. 4 is a schematic plan view showing a loop heat pipe 100 according to the first embodiment.

As shown in FIG. 4, the loop heat pipe 100 according to the first embodiment is equipped with an evaporator 110, a condenser 120, a vapor pipe 130, and a liquid pipe 140. The loop heat pipe 100 can be housed in a mobile electronic device 102 such as a smartphone or a tablet terminal.

In the loop heat pipe 100, the evaporator 110 is configured to generate vapor Cv by evaporating working fluid C. The condenser 120 is configured to condense the vapor Cv. The evaporator 110 and the condenser 120 are connected to each other by the vapor pipe 130 and the liquid pipe 140, and the vapor pipe 130 and the liquid pipe 140 form a flow channel that is a loop through which the working fluid C or the vapor Cv flows.

The liquid pipe 140 is formed with an injection inlet 141 through which working fluid C is injected. The injection inlet 141 is closed after injection of working fluid C.

Figure 5:
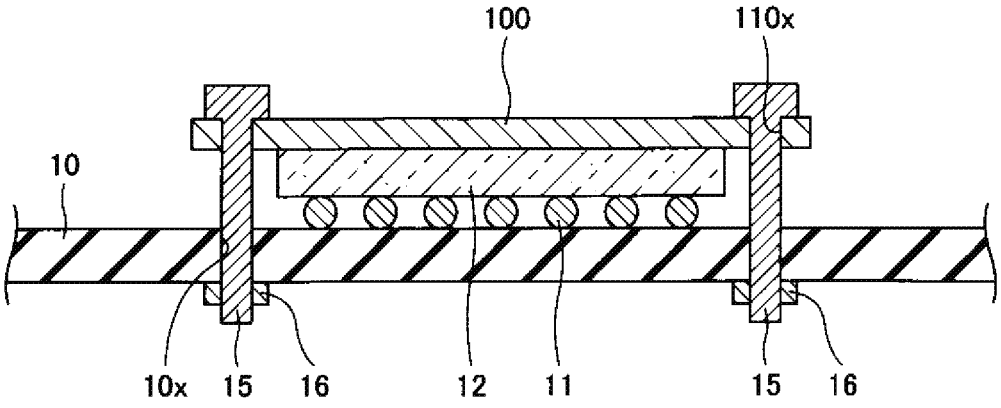
FIG. 5 is a sectional view showing an evaporator and its neighborhood of the loop heat pipe according to the first embodiment.

FIG. 5 is a sectional view showing the evaporator 110 and its neighborhood of the loop heat pipe 100 according to the first embodiment. As shown in FIGS. 4 and 5, the evaporator 110 is formed with four through-holes 110*x*, for example. The evaporator 110 is fixed to a circuit board 10 by inserting bolts 15 through the respective through-holes 110*x* and engaging nuts 16 with them from the side of the bottom surface of the circuit board 10.

A heat generation component 12 such as a CPU is mounted on the circuit board 10 via bumps 11, and the top surface of the heat generation component 12 is in close contact with the bottom surface of the evaporator 110. The working fluid C in the evaporator 110 is evaporated by heat generated by the heat generation component 12 and vapor Cv is thereby generated.

As shown in FIG. 4, vapor Cv generated by the evaporator 110 is guided to the condenser 120 through the vapor pipe 130 and condensed in the condenser 120. As a result, heat that was generated by the heat generation component 12 is moved to the condenser 120, whereby temperature increase of the heat generation component 12 is suppressed. Working fluid C produced by the condenser 120 through condensing process passes through the liquid pipe 140 and is thereby guided to the evaporator 110. For example, the widths $W_1$ and $W_2$ of the vapor pipe 130 and the liquid pipe 140 may be set at about 8 mm and 6 mm, respectively. However, the widths $W_1$ and $W_2$ of the vapor pipe 130 and the liquid pipe 140 are not limited to these values and may be identical, for example.

There are no particular limitations on the kind of the working fluid C. To cool the heat generation component 12 efficiently using heat of evaporation, it is preferable to use a fluid having a high saturated vapor pressure and a large heat of evaporation. Examples of such a fluid are ammonia, water, chlorofluorocarbon, alcohol, and acetone.

Figure 6A:
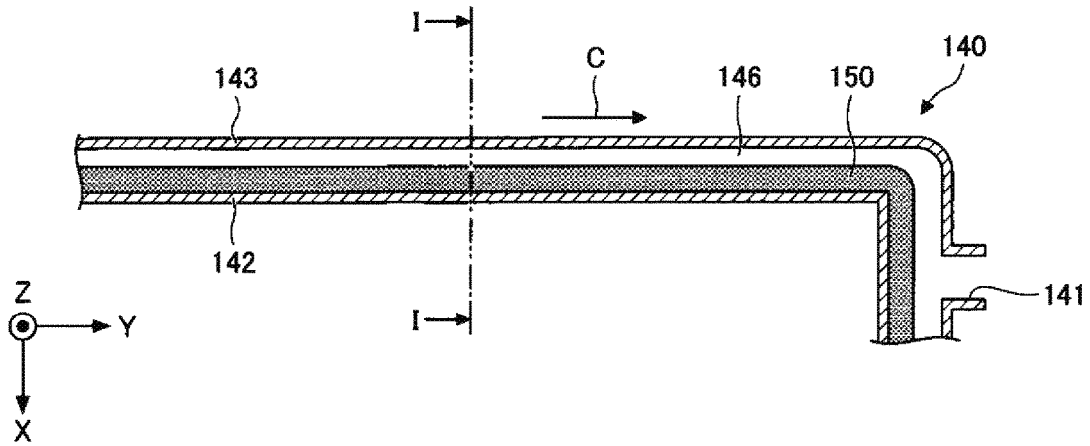
FIGS. 6A and 6B are a partial schematic plan view and a sectional view taken along line I-I in FIG. 6A, respectively, showing an example internal structure of a liquid pipe of the loop heat pipe according to the first embodiment.
Figure 6B:
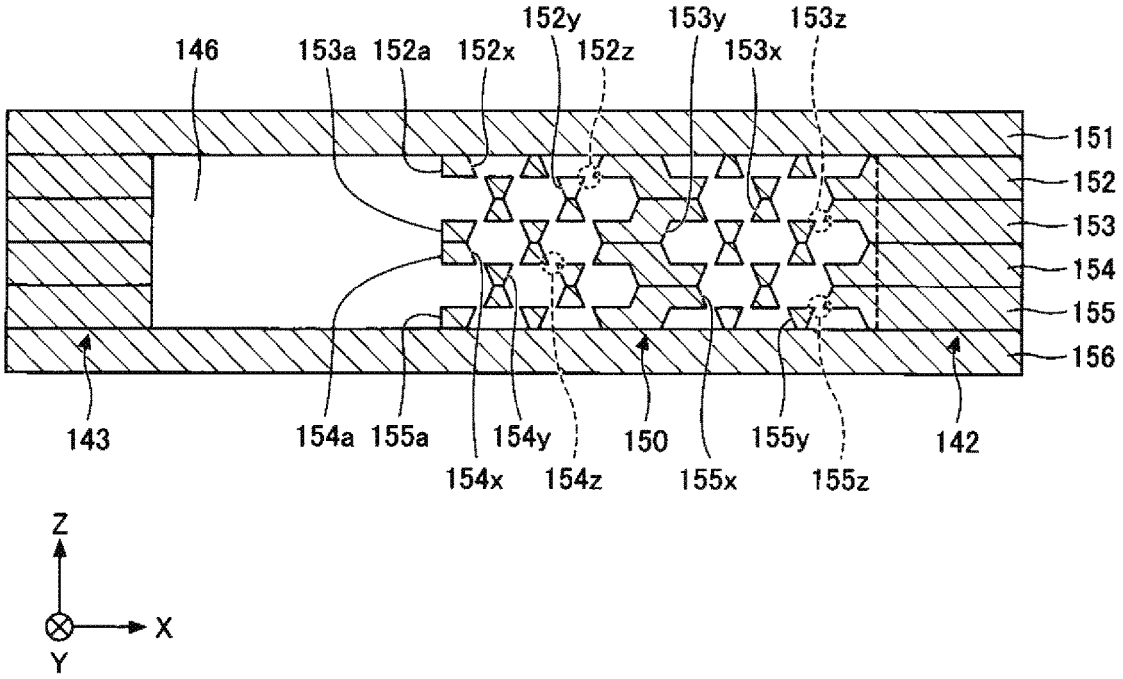

As shown in FIG. 6B, each of the evaporator 110, the condenser 120, the vapor pipe 130, and the liquid pipe 140 may have, for example a structure in which plural metal layers are stacked one on another. The metal layers are, for example, copper layers which are superior in heat conductivity and are joined to each other directly by solid-phase joining or the like. The thickness of each metal layer may be about 50 to 200 μm, for example.

The meal layers are not limited to copper layers and may be stainless steel layers, aluminum layers, magnesium alloy layers, or the like. There are no particular limitations on the number of metal layers stacked one on another.

FIGS. 6A and 6B show an example inside structure of the liquid pipe 140 of the loop heat pipe 100 according to the first embodiment. FIG. 6A is a partial schematic plan view and FIG. 6B is a sectional view taken along line I-I in FIG. 6A. FIG. 6A is drawn in such a manner that the uppermost metal layer 151 of metal layers 151-156 shown in FIG. 6B is omitted.

As shown in FIGS. 6A and 6B, a porous body 150 is formed so as to be in contact with an inside pipe wall 142 (an example of a "first pipe wall") of the liquid pipe 140. The porous body 150 extends from the condenser 120 to the evaporator 110 along the liquid pipe 140, and a flow channel 146 of the liquid pipe 140 is formed between the porous body 150 and an outside pipe wall 143 (an example of a "second pipe wall"). The porous body 150 is in contact with, that is, is integrally formed with the pipe wall 142. The porous body 150 may be in contact with the pipe wall 142 over the full length of the porous body 150. The flow channel 146 is a space formed inside the liquid pipe 140 and is in contact with the pipe wall 143.

As described above, the one flow channel 146 is formed inside (i.e., on the side of the pipe wall 142) in the liquid pipe 140 and the one flow channel 146 is formed outside (i.e., on the side of the pipe wall 143) in the liquid pipe 140. In other words, the porous body 150 is disposed alongside (adjacent to) the pipe wall surface (of the pipe wall 142) that is opposed to the injection inlet 141. The flow channel 146 is a space that is formed on the side of the pipe wall surface (of the pipe wall 143) in which the injection inlet 141 is formed. The injection inlet 141 communicates with the flow channel 146.

The structures of the liquid pipe 140 and the porous body 150 will be described below. FIGS. 7A-7D are plan views showing example arrangements of bottomed holes in second to fifth metal layers 152-155, respectively. The cross section of the porous body 150 shown in FIG. 6B corresponds to cross sections taken along lines II-II in FIGS. 7A-7D.

For example, the liquid pipe 140 and the porous body 150 may have a structure that six metal layers 151-156 are laid one on another. The metal layers 151-156 are, for example, copper layers which are superior in thermal conductivity and are joined to each other directly by solid-phase joining or the like. The thickness of each of the metal layers 151-156 may be about 50 to 200 μm, for example. The metal layers 151-156 are not limited to metal layers and may be stainless steel layers, aluminum layers, magnesium alloy layers, or the like. There are no particular limitations on the number of metal layers laid one on another; five or less metal layers or seven or more metal layers may be laid one on another.

In FIGS. 6B and 7A-7D, the Z direction is defined as the lamination direction of the metal layers 151-156, the X direction is defined as an optional direction in the plane perpendicular to the Z direction, and the Y direction is defined as the direction perpendicular to the X direction in this plane (these definitions also apply to following similar drawings).

Figures 7A, 7B, 7C, 7D:
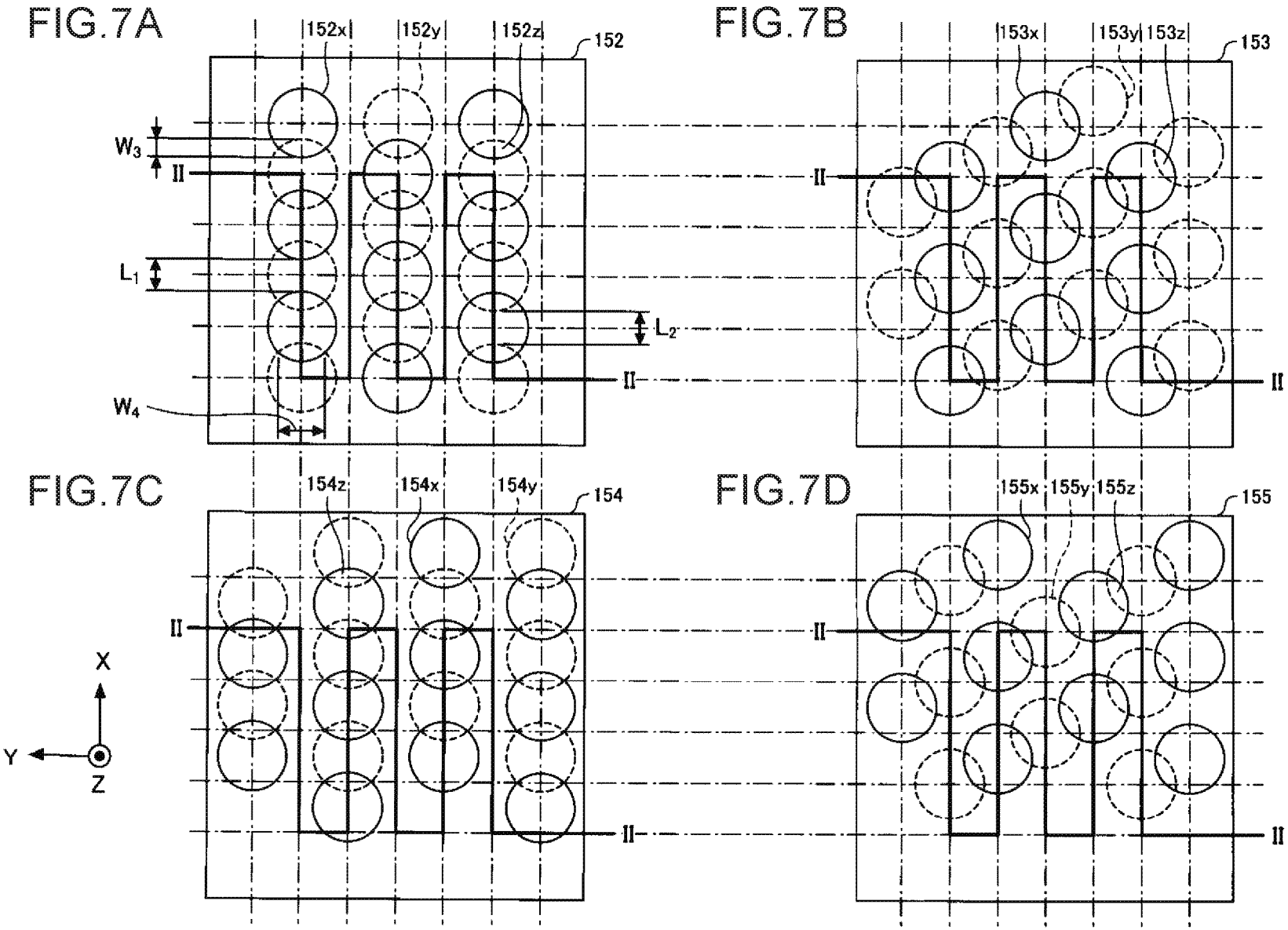
FIGS. 7A-7D are plan views showing example arrangements of bottomed holes in the second, third, fourth, and fifth metal layers, respectively.

In the liquid pipe 140 and the porous body 150, no holes or grooves are formed in the first metal layer 151 (one outermost metal layer) or the sixth metal layer 156 (the other outermost metal layer). On the other hand, as shown in FIGS. 6B and 7A, plural bottomed holes 152*x* which are recessed from the top surface to approximately the center in the thickness direction and plural bottomed holes 152*y* which are recessed from the bottom surface to approximately the center in the thickness direction are formed in the second metal layer 152 and in the porous body 150. As shown in FIG. 6B, an opening portion 152*a* which is part of the flow channel 146 is also formed in the metal layer 152. The opening portion 152*a* is a through-hole that penetrates through the metal layer 152 in the thickness direction (Z direction).

Bottomed holes 152*x* and bottomed holes 152*y* are arranged alternately in the X direction, and bottomed holes 152*x* and a bottomed hole 152*y* are arranged alternately the Y direction in a plan view. Adjacent ones of bottomed holes 152*x* and bottomed holes 152*y* that are arranged alternately in the X direction overlap with each other in a plan view and the adjacent bottomed holes 152*x* and 152*y* communicate with each other in the overlap to form a pore 152*z*. Bottomed holes 152*x* and a bottomed hole 152*y* that are arranged alternately in the Y direction have prescribed intervals and do not overlap in a plan view. Thus, bottomed holes 152*x* and bottomed holes 152*y* that are arranged alternately in the Y direction do not form any pores. However, the invention is not limited to this case; bottomed holes 152*x* and bottomed holes 152*y* that are arranged alternately in the Y direction may overlap in a plan view and form pores.

The bottomed holes 152*x* and 152*y* may be circular holes of about 100 to 300 μm in diameter, for example; however, they may have any shape such as an ellipse or a polygon. For example, the depth of the bottomed holes 152*x* and 152*y* may be approximately half of that of the metal layer 152. The interval $L_1$ between adjacent bottomed holes 152*x* may be about 100 to 400 μm, for example. The interval $L_2$ between adjacent bottomed holes 152*y* may be about 100 to 400 μm, for example.

The inner wall surface of each of the bottomed holes 152*x* and 152*y* may be tapered so that the hole width increases as the position goes from the bottom side to the opening side. However, the invention is not limited to this case; the inner wall surface of each of the bottomed holes 152*x* and 152*y* may be perpendicular to the bottom surface or may be curved so as to assume a semicircle. The shorter width $W_3$ of each pore 152*z* may be set at about 10 to 50 μm, for example, and the longer width $W_4$ of each pore 152*z* may be set at about 50 to 150 μm, for example.

As shown in FIGS. 6B and 7B, plural bottomed holes 153*x* which are recessed from the top surface to approximately the center in the thickness direction and plural bottomed holes 153*y* which are recessed from the bottom surface to approximately the center in the thickness direction are formed in the third metal layer 153 and in the porous body 150. As shown in FIG. 6B, an opening portion 153*a* which is part of the flow channel 146 is also formed in the metal layer 153. The opening portion 153*a* is a through-hole that penetrates through the metal layer 153 in the thickness direction (Z direction).

In the third metal layer 153, rows in which only bottomed holes 153*x* are arranged in the X direction and rows in which only bottomed holes 153*y* are arranged in the X direction are arranged alternately in the Y direction. Adjacent ones of the bottomed holes 153*x* and the bottomed holes 153*y* in adjacent rows among the rows that are arranged alternately in the Y direction overlap with each other in a plan view and communicate with each other in the overlap to form a pore 153*z*.

However, the center positions of bottomed holes 153*x* and 153*y* that form each pore 153*z* are deviated from each other in the X direction. In other words, bottomed holes 153*x* and bottomed holes 153*y* that form pores 153*z* are arranged alternately in a direction that is inclined from the X direction and the Y direction. For example, the shapes etc. of the bottomed holes 153*x* and 153*y* and the pores 153*z* may be the same as those of the bottomed holes 152*x* and 152*y* and the pores 152*z*.

The bottomed holes 152*y* of the second metal layer 152 and the bottomed holes 153*x* of the third metal layer 153 are formed so as to coincide with each other in a plan view. Thus, no pores are formed in the interface between the first metal layer 152 and the second metal layer 153. However, the invention is not limited to this case; the arrangements of the bottomed holes 153*x* and the bottomed holes 153*y* in the X direction and the Y direction may be changed as appropriate so that pores are formed in the interface between the second metal layer 152 and the third metal layer 153.

As shown in FIGS. 6B and 7C, plural bottomed holes 154*x* which are recessed from the top surface to approximately the center in the thickness direction and plural bottomed holes 154*y* which are recessed from the bottom surface to approximately the center in the thickness direction are formed in the fourth metal layer 154 and in the porous body 150. As shown in FIG. 6B, an opening portion 154*a* which is part of the flow channel 146 is also formed in the metal layer 154. The opening portion 154*a* is a through-hole that penetrates through the metal layer 154 in the thickness direction (Z direction).

Bottomed holes 154*x* and bottomed holes 154*y* are arranged alternately in the X direction, and bottomed holes 154*x* and bottomed holes 154*y* are arranged alternately the Y direction in a plan view. Adjacent ones of bottomed holes 154*x* and bottomed holes 154*y* that are arranged alternately in the X direction overlap with each other in a plan view and the adjacent bottomed holes 154*x* and 154*y* communicate with each other in the overlap to form a pore 154*z*. Bottomed holes 154*x* and a bottomed hole 154*y* that are arranged alternately in the Y direction have prescribed intervals and do not overlap in a plan view. Thus, bottomed holes 154*x* and a bottomed holes 154*y* that are arranged alternately in the Y direction do not form any pores. However, the invention is not limited to this case; bottomed holes 154*x* and a bottomed hole 154*y* that are arranged alternately in the Y direction may overlap in a plan view and form pores. For example, the shapes etc. of the bottomed holes 154*x* and 154*y* and the pores 154*z* may be the same as those of the bottomed holes 152*x* and 152*y* and the pores 152*z*.

The bottomed holes 153*y* of the third metal layer 153 and the bottomed holes 154*x* of the fourth metal layer 154 are formed so as to coincide with each other in a plan view. Thus, no pores are formed in the interface between the third metal layer 153 and the fourth metal layer 154. However, the invention is not limited to this case; the arrangements of the bottomed holes 154*x* and the bottomed holes 154*y* in the X direction and the Y direction may be changed as appropriate so that pores are formed in the interface between the third metal layer 153 and the fourth metal layer 154.

As shown in FIGS. 6B and 7D, plural bottomed holes 155*x* which are recessed from the top surface to approximately the center in the thickness direction and plural bottomed holes 155*y* which are recessed from the bottom surface to approximately the center in the thickness direction are formed in the fifth metal layer 155 and in the porous body 150. As shown in FIG. 6B, an opening portion 155*a* which is part of the flow channel 146 is also formed in the metal layer 155. The opening portion 155*a* is a through-hole that penetrates through the metal layer 155 in the thickness direction (Z direction).

In the fifth metal layer 155, rows in which only bottomed holes 155*x* are arranged in the X direction and rows in which only bottomed holes 155*y* are arranged in the X direction are arranged alternately in the Y direction. Adjacent ones of the bottomed holes 155*x* and the bottomed holes 155*y* in adjacent rows among the rows that are arranged alternately in the Y direction overlap with each other in a plan view and communicate with each other in the overlap to form a pore 155*z*.

However, the center positions of bottomed holes 155*x* and 155*y* that form each pore 153*z* are deviated from each other in the X direction. In other words, bottomed holes 155*x* and bottomed holes 155*y* that form pores 155*z* are arranged alternately in a direction that is inclined from the X direction and the Y direction. For example, the shapes etc. of the bottomed holes 155*x* and 155*y* and the pores 155*z* may be the same as those of the bottomed holes 152*x* and 152*y* and the pores 152*z*.

The bottomed holes 154*y* of the fourth metal layer 152 and the bottomed holes 155*x* of the fifth metal layer 155 are formed so as to coincide with each other in a plan view. Thus, no pores are formed in the interface between the fourth metal layer 154 and the fifth metal layer 155. However, the invention is not limited to this case; the arrangements of the bottomed holes 155*x* and the bottomed holes 155*y* in the X direction and the Y direction may be changed as appropriate so that pores are formed in the interface between the fourth metal layer 154 and the fifth metal layer 155.

The pores formed in each metal layer communicate with each other and together extend through the porous body 150 three-dimensionally. As a result, because of capillary forces, working fluid C expands three-dimensionally through the pores that communicate with each other.

As described above, the porous body 150 is disposed in the liquid pipe 140 and liquid-phase working fluid C in the liquid pipe 140 is guided to the evaporator 110 by the capillary forces produced in the porous body 150.

As a result, even if vapor Cv is forced to flow reversely into the liquid pipe 140 due to, for example, heat leakage from the evaporator 110, the capillary forces acting on liquid-phase working fluid C in the porous body 150 can push back the vapor Cv. A reverse flow of the vapor Cv can thus be prevented.

Part of the porous body 150 is provided in the evaporator 110. In the evaporator 110, liquid-phase working fluid C permeates into a portion, located on the side of the liquid pipe 140, of that part of the porous body 150 which is provided in the evaporator 110. Resulting capillary forces acting on that portion of the working fluid C from the porous body 150 serve as pumping force for circulating the working fluid C through the loop heat pipe 100.

Since the capillary forces counter the vapor Cv existing in the evaporator 110, a reverse flow of the vapor Cv into the liquid pipe 140 can be suppressed.

Although the liquid pipe 140 is formed with the injection inlet 141 for injecting working fluid C, the inside of the loop heat pipe 100 is kept airtight because the injection inlet 141 is closed.

Figure 8:
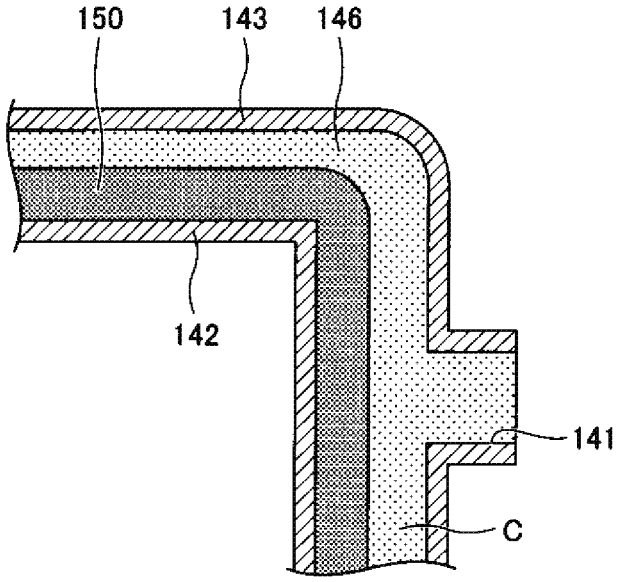
FIG. 8 is a partial schematic plan view showing part of the liquid pipe employed in the first embodiment and working fluid flowing through it.

How working fluid C injected into the liquid pipe 140 behaves in the first embodiment will now be described. FIG. 8 is a partial schematic plan view showing part of the liquid pipe 140 employed in the first embodiment and working fluid C flowing through it.

Liquid-phase working fluid C that has been injected into the liquid pipe 146 through the injection inlet 141 spreads over the flow channel 146 and the flow channel 146 is filled with working fluid C. The working fluid C is pulled by the capillary forces of the porous body 150 and the inside of the liquid pipe 140 is thereby filled with the working fluid C. Since unlike in the reference example not both sides (inside and outside) of the porous body 150 are provided with a flow channel, no part of the working fluid C flows into an inside flow channel and no air bubbles remain there.

As a result, in the loop heat pipe 100 according to the first embodiment, a phenomenon that air bubbles produced in the flow channel 146 obstruct flow of liquid-phase working fluid C can be suppressed, whereby superior heat transport performance can be obtained. Furthermore, swelling of the liquid pipe 140 due to air bubbles can be suppressed.

[Manufacturing Method of Loop Heat Pipe]

Next, a manufacturing method of a loop heat pipe according to the first embodiment, mainly a manufacturing method of a porous body, will be described below. FIGS. 9A-9D and FIGS. 10A and 10B are sectional views showing an example manufacturing method of a loop heat pipe according to the first embodiment (FIG. 10B is the same as FIG. 6B).

Figure 9A:
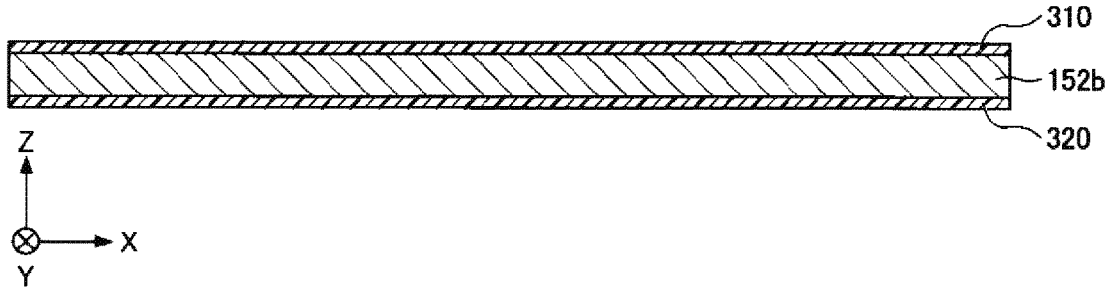
FIGS. 9A-9D are a first set of sectional views showing an example manufacturing method of the loop heat pipe according to the first embodiment.

First, in a step shown in FIG. 9A, a metal sheet 152*b* having the plan-view shape shown in FIG. 4 is prepared. Then resist layers 310 and 320 are formed on the top surface and the bottom surface of the metal sheet 152*b*, respectively. The metal sheet 152*b*, which is to become a metal layer 152 finally, may be made of copper, stainless steel, aluminum, a magnesium alloy, or the like. The thickness of the metal sheet 152*b* may be about 50 to 200 μm, for example. The resist layers 310 and 320 may be made of a photosensitive dry film resist, for example.

Figure 9B:
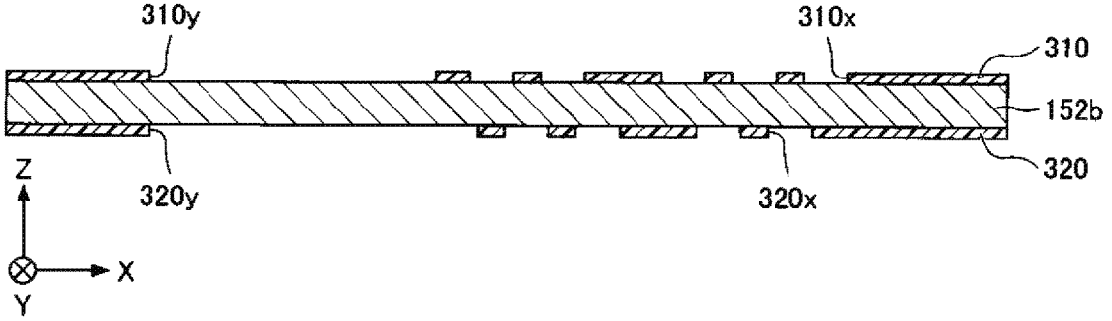

Then, in a step shown in FIG. 9B, openings 310*x* for exposing selected portions of the top surface of the metal sheet 152*b* are formed by subjecting the resist layer 310 to exposure to light and development in a region, where to form a porous body 150, of the metal sheet 152*b*. Furthermore, openings 320*x* for exposing selected portions of the bottom surface of the metal sheet 152*b* are formed by subjecting the resist layer 320 to exposure to light and development in the same region of the metal sheet 152*b*. The shapes and the arrangement of the openings 310*x* and openings 320*x* are made the same as those of the bottomed holes 152*x* and 152*y* shown in FIG. 7A.

As shown in FIG. 9B, when the resist layer 310 is subjected to exposure to light and development, an opening 310*y* for exposing a selected portion of the top surface of the metal sheet 152*b* is formed in a region where to form a flow channel 146. Furthermore, an opening 320*y* for exposing a selected portion of the bottom surface of the metal sheet 152*b* is formed in the region where to form a flow channel 146.

Figure 9C:
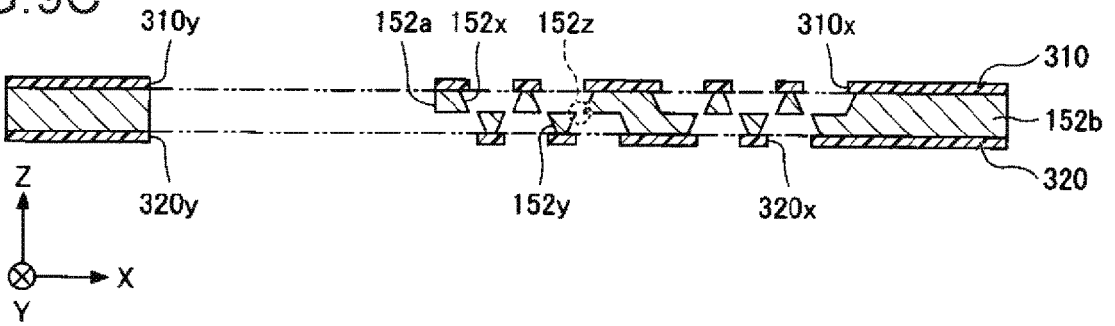

Then, in a step shown in FIG. 9C, portions, exposed through the openings 310*x* and 310*y*, of the metal sheet 152*b* are half-etched from the top surface side and portions, exposed through the openings 320*x* and 320*y*, of the metal sheet 152*b* are half-etched from the bottom surface side. As a result, bottomed holes 152*x* are formed in the metal sheet 152*b* on the top-surface side, bottomed holes 152*y* are formed in the metal sheet 152*b* on the bottom-surface side, and an opening portion 152*a* is formed so as to penetrate through the metal sheet 152*b*. Since adjacent ones of the openings 310*x* (front side) and the openings 310*y* (back side) which are arranged alternately in the X direction overlap with each other in a plan view, they communicate with each other in the overlap and form a pore 152*z*. The metal sheet 152*b* may be half-etched using a ferric chloride solution, for example.

Figure 9D:
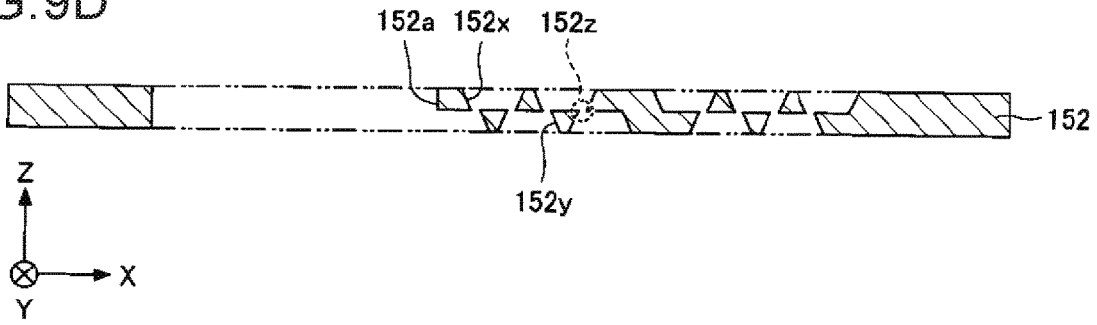

Then, in a step shown in FIG. 9D, the resist layers 310 and 320 are peeled off using a peeling liquid. A metal layer 152 is thus completed.

Figure 10A:
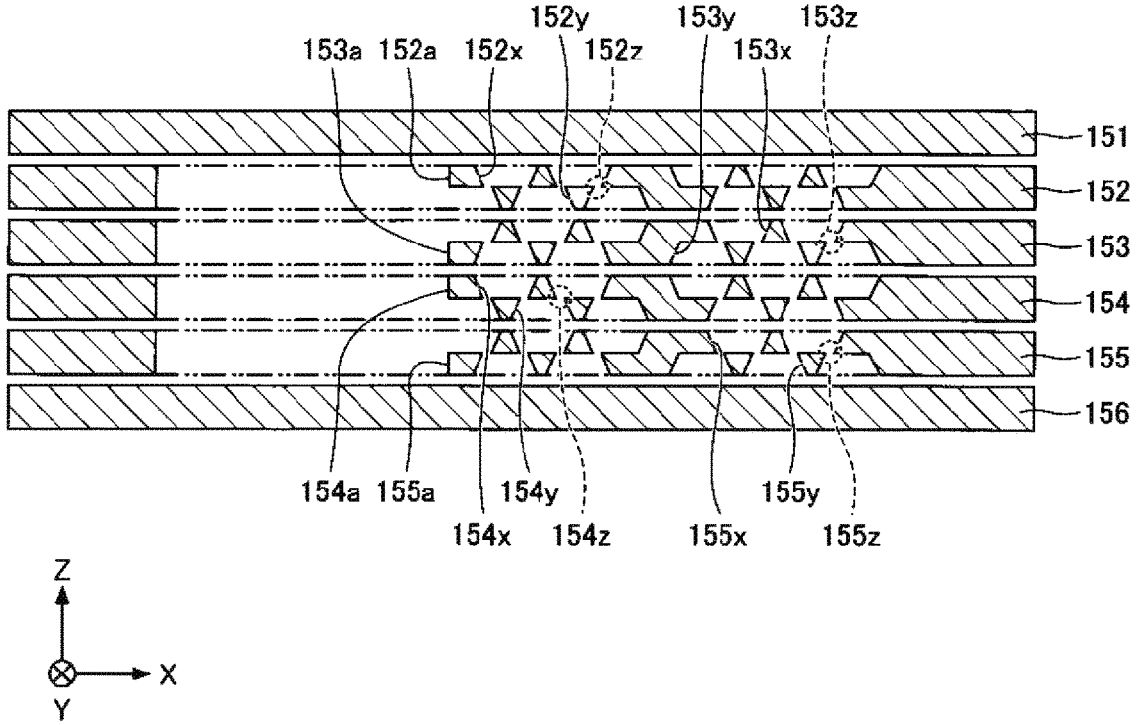
FIGS. 10A and 10B are a second set of sectional views showing the example manufacturing method of the loop heat pipe according to the first embodiment.
Figure 10B:
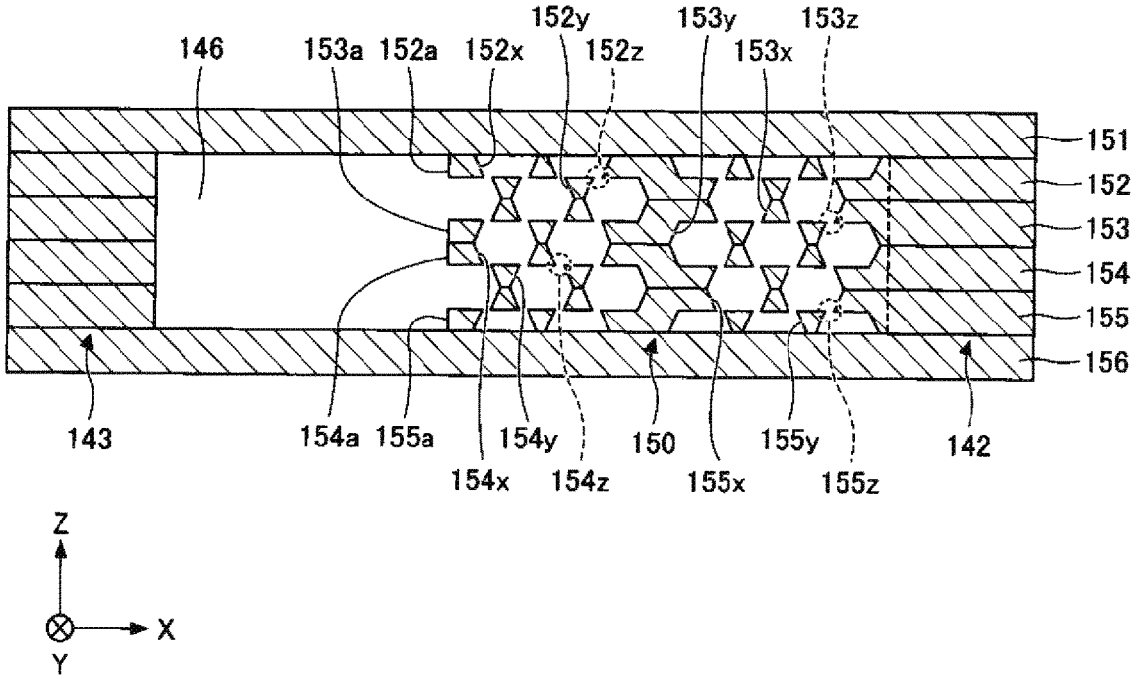

Subsequently, in a step shown in FIG. 10A, solid metal layers 151 and 156 which are formed with no holes or grooves are prepared. Metal layers 153, 154, and 155 are formed by the same method as the metal layer 152 was formed. The positions of bottomed holes, pores, and openings formed in the metal layers 153, 154, and 155 are made the same as those shown in FIGS. 7B-7D.

Subsequently, in a step shown in FIG. 10B, the metal layers 151-156 are stacked one on another in the order shown in FIG. 10A and subjected to solid-phase joining through pressing and heating. As a result, adjoining metal layers are joined together directly, whereby a loop heat pipe 100 is completed which is equipped with an evaporator 110, a condenser 120, a vapor pipe 130, and a liquid pipe 140 and a porous body 150 is formed in the evaporator 110 and the liquid pipe 140. The porous body 150 is integrally formed with an inside pipe wall 142 of the liquid pipe 140 and a flow channel 146 as a space for guiding working fluid C to the evaporator 110 is formed between an outside pipe wall 143 and the porous body 150. After evacuating the inside of the liquid pipe 140 using a vacuum pump or the like, working fluid C is injected into the flow channel 146 through the injection inlet 141 and the injection inlet 141 is then sealed.

The above-mentioned solid-phase joining is a method for joining target objects by heating them to soften them while keeping them in a solid phase (i.e., without melting them) and, furthermore, pressing them against each other to deform them plastically. To allow adjoining metal layers to be joined together satisfactorily by solid-phase joining, it is preferable that all of the metal layers 151-156 be made of the same material.

Since as described above pores are formed in each metal layer by forming bottomed holes from both sides of the metal layer in such a manner that they communicate with each other partially, problems of the conventional pore forming method in which metal layers formed with through-holes are stacked one on another in such a manner through-holes overlap with each other can be solved. More specifically, pores having a constant size can be formed in the metal layers 152 to 155 without causing positional deviations because the pores are not affected by positional deviations that may occur when the metal layers 152 to 155 are stacked one on another or positional deviations that may occur due to expansion and contraction of the metal layers 152 to 155 when they are subjected to heating when laid one on another.

As a result, reduction of capillary forces of the pores due to a variation of their sizes and hence the effect of suppressing a reverse flow of vapor Cv from the evaporator 110 to the liquid pipe 140 can be obtained stably.

At the interface between two metal layers, each associated pair of bottomed holes in the two metal layers are formed so as to coincide with each other in a plan view, whereby the contact area of the two metal layers can be increased to enable strong joining.

Embodiment 2

Figure 11:
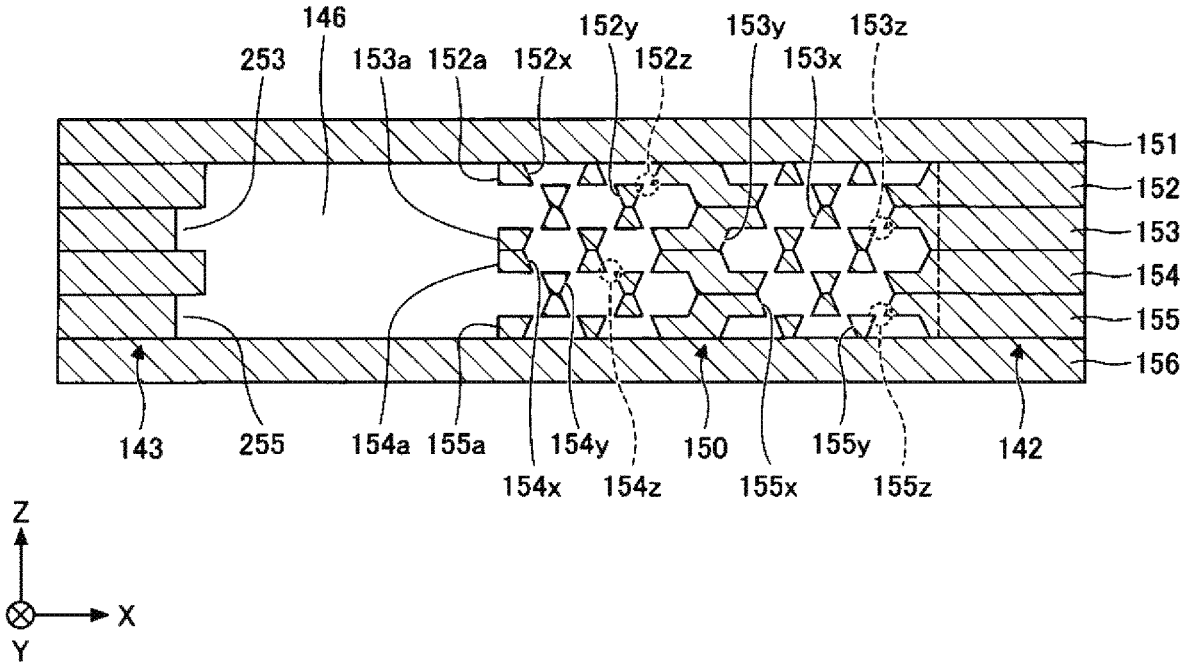
FIG. 11 is a sectional view showing an example liquid pipe and porous body employed in a second embodiment.

Next, a second embodiment will be described which is different from the first embodiment in the shape of the outside pipe wall 143 of the liquid pipe 140. FIG. 11 is a sectional view showing an example liquid pipe 140 and porous body 150 employed in the second embodiment.

Like the loop heat pipe 100 according to the first embodiment, the loop heat pipe according to the second embodiment is equipped with a liquid pipe 140 and a porous body 150. The porous body 150 is formed in the same manner as in the first embodiment and is formed to be in contact with an inside pipe wall 142 of the loop of the liquid pipe 140 in the same manner as in the first embodiment.

On the other hand, as shown in FIG. 11, on the side of an outside pipe wall 143 of the liquid pipe 140, opening portions 153*a* and 155*a* are larger than opening portions 152*a* and 154*a* and the side surfaces of the opening portions 153*a* and 155*a* are recessed from those of the opening portions 152*a* and 154*a*. Thus, in the second embodiment, on the side of the outside pipe wall 143, the position, in the X direction, of the side surfaces of the opening portions 153*a* and 155*a* is deviated from that of the side surfaces of the opening portions 152*a* and 154*a*, whereby a groove 253 is formed in a metal layer 153 and a groove 255 is formed in a metal layer 155. For example, the grooves 253 and 255 are formed so as to extend in the extension direction of the liquid pipe 140 (in the Y direction, approximately parallel with a flow channel 146).

The second embodiment is the same as the first embodiment in the other part of the configuration.

The second embodiment can provide the same advantages as the first embodiment. In addition, the grooves 253 and 255 which are formed in the wall surface of the pipe wall 143 of the flow channel 146 accelerate flow of liquid-phase working fluid C, whereby the heat transport performance can be enhanced further.

Embodiment 3

Figure 12:
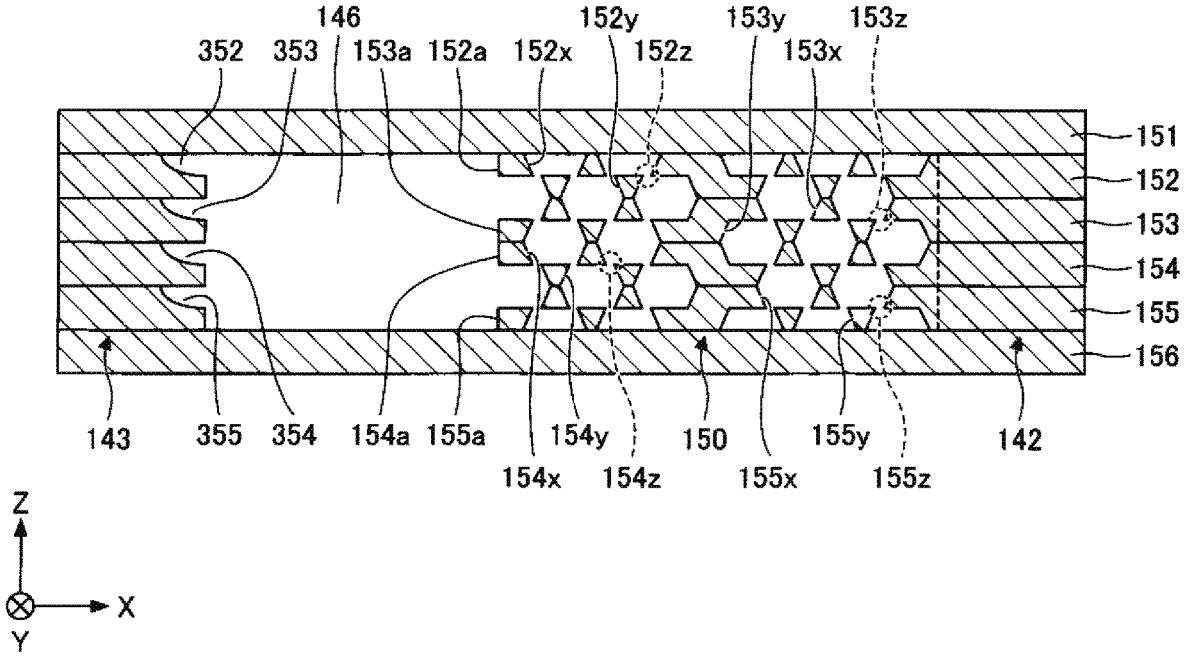
FIG. 12 is a sectional view showing an example liquid pipe and porous body employed in a third embodiment.

Next, a third embodiment will be described which is different from the first and second embodiments in the shape of the outside pipe wall 143 of the liquid pipe 140. FIG. 12 is a sectional view showing an example liquid pipe 140 and porous body 150 employed in the third embodiment.

Like the loop heat pipe 100 according to the first embodiment, the loop heat pipe according to the third embodiment is equipped with a liquid pipe 140 and a porous body 150. The porous body 150 is formed in the same manner as in the first embodiment and is formed so as to be in contact with an inside pipe wall 142 of the loop of the liquid pipe 140 in the same manner as in the first embodiment.

On the other hand, as shown in FIG. 12, on the side of an outside pipe wall 143 of the liquid pipe 140, a groove 352 that is recessed from the top surface to approximately the center in the thickness direction is formed at a periphery of an opening portion 152*a* in the same manner as a bottomed hole 152*x*. That is, the top surface of a metal layer 152 is formed with the groove 352 that is continuous with a flow channel 146. The depth of the groove 352 may be, for example, approximately half of the thickness of the metal layer 152.

As shown in FIG. 12, on the side of the outside pipe wall 143, a groove 353 that is recessed from the top surface to approximately the center in the thickness direction is formed at a periphery of an opening portion 153*a* in the same manner as a bottomed hole 153*x*. That is, the top surface of a metal layer 153 is formed with the groove 353 that is continuous with the flow channel 146. The depth of the groove 353 may be, for example, approximately half of the thickness of the metal layer 153.

As shown in FIG. 12, on the side of the outside pipe wall 143, a groove 354 that is recessed from the top surface to approximately the center in the thickness direction is formed at a periphery of an opening portion 154*a* in the same manner as a bottomed hole 154*x*. That is, the top surface of a metal layer 154 is formed with the groove 354 that is continuous with the flow channel 146. The depth of the groove 354 may be, for example, approximately half of the thickness of the metal layer 154.

As shown in FIG. 12, on the side of the outside pipe wall 143, a groove 355 that is recessed from the top surface to approximately the center in the thickness direction is formed at a periphery of an opening portion 155*a* in the same manner as a bottomed hole 155*x*. That is, the top surface of a metal layer 155 is formed with the groove 355 that is continuous with the flow channel 146. The depth of the groove 355 may be, for example, approximately half of the thickness of the metal layer 155.

For example, the grooves 352 to 355 are formed so as to extend in the extension direction of the liquid pipe 140 (in the Y direction, approximately parallel with the flow channel 146).

The third embodiment is the same as the first embodiment in the other part of the configuration.

The third embodiment can provide the same advantages as the first and second embodiments. In addition, the grooves 352 to 355 which are formed in the wall surface of the pipe wall 143 of the flow channel 146 accelerate flow of liquid-phase working fluid C. With an additional feature that the number of grooves is larger than in the second embodiment, the heat transport performance can be enhanced even further.

For example, the groove 352 can be formed at the same time as the bottomed holes 152*x* in the following manner. That is, when the openings 310*x* are formed through the resist layer 310 which is used for forming the bottomed holes 152*x*, an opening is also formed in a region where the groove 352 is to be formed and the metal sheet 152*b* is half-etched. In this manner, the groove 352 can be formed at the same time as the bottomed holes 152*x*. Likewise, for example, the grooves 353, 354, 355 can be formed at the same time as the bottomed holes 153*x*, 154*x*, and 155*x*, respectively.

Embodiment 4

Figure 13:
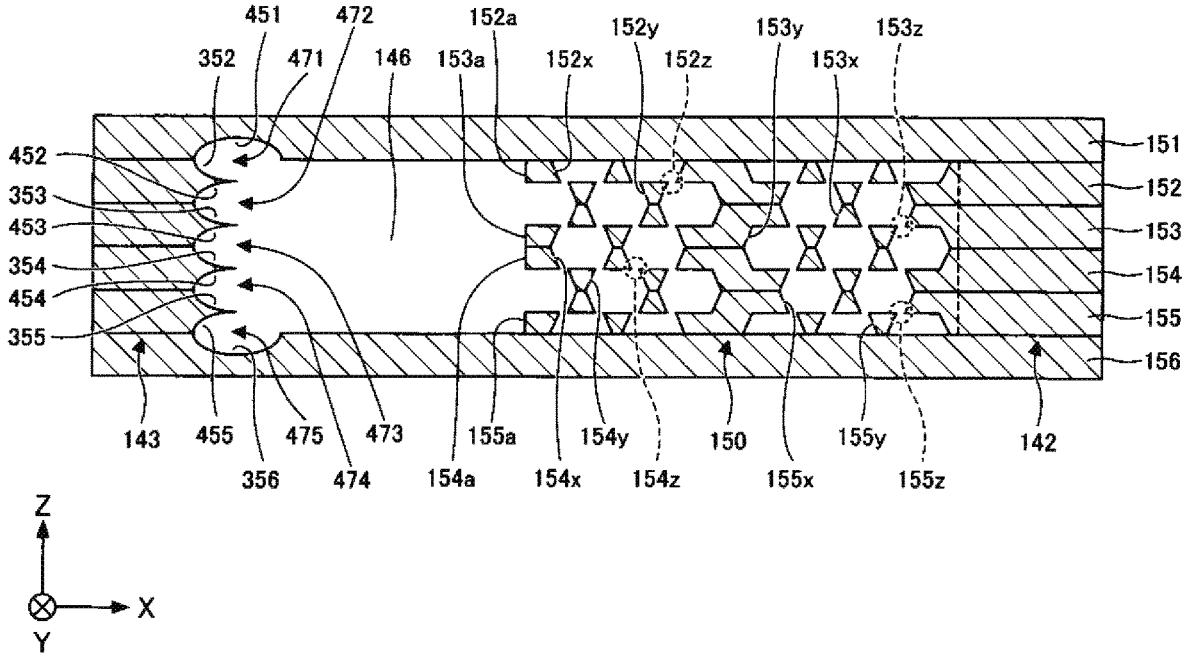
FIG. 13 is a sectional view showing an example liquid pipe and porous body employed in a fourth embodiment.

Next, a fourth embodiment will be described which is different from the first to third embodiments in the shape of the outside pipe wall 143 of the liquid pipe 140. FIG. 13 is a sectional view showing an example liquid pipe 140 and porous body 150 employed in the fourth embodiment.

Like the loop heat pipe 100 according to the first embodiment, the loop heat pipe according to the fourth embodiment is equipped with a liquid pipe 140 and a porous body 150. The porous body 150 is formed in the same manner as in the first embodiment and is formed so as to be in contact with an inside pipe wall 142 of the loop of the liquid pipe 140 in the same manner as in the first embodiment.

On the other hand, as shown in FIG. 13, on the side of an outside pipe wall 143 of the liquid pipe 140, not only a groove 352 but also a groove 452 that is recessed from the bottom surface to approximately the center in the thickness direction is formed at a periphery of an opening portion 152*a* in the same manner as a bottomed hole 152*y*. That is, the bottom surface of a metal layer 152 is formed with the groove 452 that is continuous with a flow channel 146. The depth of the groove 452 may be, for example, approximately half of the thickness of the metal layer 152.

As shown in FIG. 13, on the side of the outside pipe wall 143, not only a groove 353 but also a groove 453 that is recessed from the bottom surface to approximately the center in the thickness direction is formed at a periphery of an opening portion 153*a* in the same manner as a bottomed hole 153*y*. That is, the bottom surface of a metal layer 153 is formed with the groove 453 that is continuous with the flow channel 146. The depth of the groove 453 may be, for example, approximately half of the thickness of the metal layer 153.

As shown in FIG. 13, on the side of the outside pipe wall 143, not only a groove 354 but also a groove 454 that is recessed from the bottom surface to approximately the center in the thickness direction is formed at a periphery of an opening portion 154*a* in the same manner as a bottomed hole 154*y*. That is, the bottom surface of a metal layer 154 is formed with the groove 454 that is continuous with the flow channel 146. The depth of the groove 454 may be, for example, approximately half of the thickness of the metal layer 154.

As shown in FIG. 13, on the side of the outside pipe wall 143, not only a groove 355 but also a groove 455 that is recessed from the bottom surface to approximately the center in the thickness direction is formed at a periphery of an opening portion 154*a* in the same manner as a bottomed hole 155*y*. That is, the bottom surface of a metal layer 155 is formed with the groove 455 that is continuous with the flow channel 146. The depth of the groove 455 may be, for example, approximately half of the thickness of the metal layer 155.

The grooves 452 and 353 are connected to each other to form a groove 472. The grooves 453 and 354 are connected to each other to form a groove 473. The grooves 454 and 355 are connected to each other to form a groove 474.

Furthermore, as shown in FIG. 13, on the side of the outside pipe wall 143, a groove 451 that is recessed from the bottom surface to approximately the center in the thickness direction is formed in a metal layer 151 so as to be continuous with the groove 352. That is, the bottom surface of the metal layer 151 is formed with the groove 451 that is continuous with the flow channel 146. The depth of the groove 451 may be, for example, approximately half of the thickness of the metal layer 151. The grooves 451 and 352 are connected to each other to form a groove 471.

As shown in FIG. 13, on the side of the outside pipe wall 143, a groove 356 that is recessed from the top surface to approximately the center in the thickness direction is formed in a metal layer 156 so as to be continuous with the groove 455. That is, the top surface of the metal layer 156 is formed with the groove 356 that is continuous with the flow channel 146. The depth of the groove 356 may be, for example, approximately half of the thickness of the metal layer 156. The grooves 455 and 356 are connected to each other to form a groove 475.

For example, the grooves 471-475 are formed so as to extend in the extension direction of the liquid pipe 140 (in the Y direction, approximately parallel with the flow channel 146).

The fourth embodiment is the same as the first embodiment in the other part of the configuration.

The fourth embodiment can provide the same advantages as the first to third embodiments. In addition, the grooves 471 to 475 which are formed in the wall surface of the pipe wall 143 of the flow channel 146 accelerate flow of liquid-phase working fluid C. With an additional feature that the number of grooves is larger than in the third embodiment, the heat transport performance can be enhanced even further.

For example, the groove 452 can be formed at the same time as the bottomed holes 152*y* in the following manner. That is, referring to FIG. 9B, when the openings 320*x* are formed through the resist layer 320, an opening is also formed in a region where the groove 452 is to be formed and the metal sheet 152*b* is half-etched. In this manner, the groove 452 can be formed at the same time as the bottomed holes 152*y*. For example, like the groove 452, the grooves 453, 454, 455 can be formed at the same time as the bottomed holes 153*y*, 154*y*, and 155*y*, respectively.

The grooves 451 and 356 of the metal layers 151 and 156 can be formed by half-etching metal sheets using resist layers having openings in regions where the grooves 451 and 356 of the metal layers 151 and 156 are to be formed.

Embodiment 5

Figure 14A:
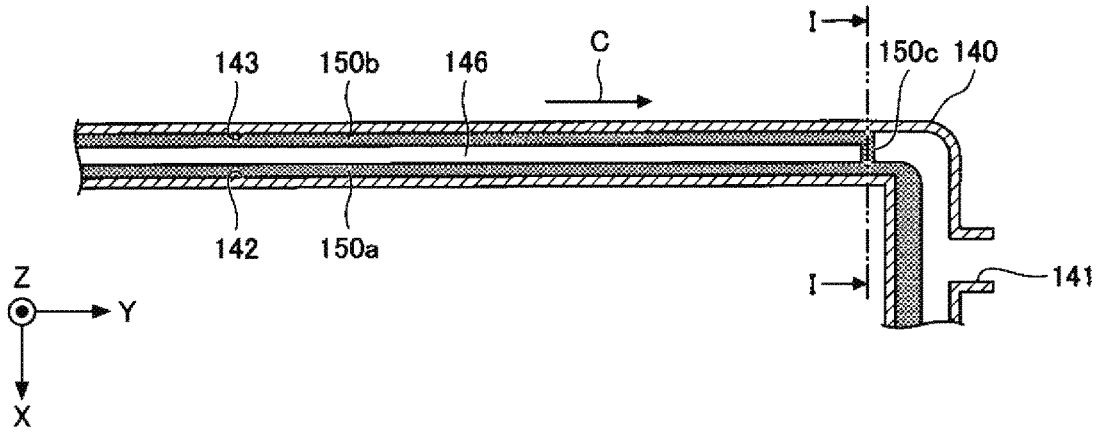
FIGS. 14A and 14B are a partial schematic plan view and a sectional view taken along line I-I in FIG. 14A, respectively, showing an example internal structure of a liquid pipe of a loop heat pipe according to a fifth embodiment.
Figure 14B:
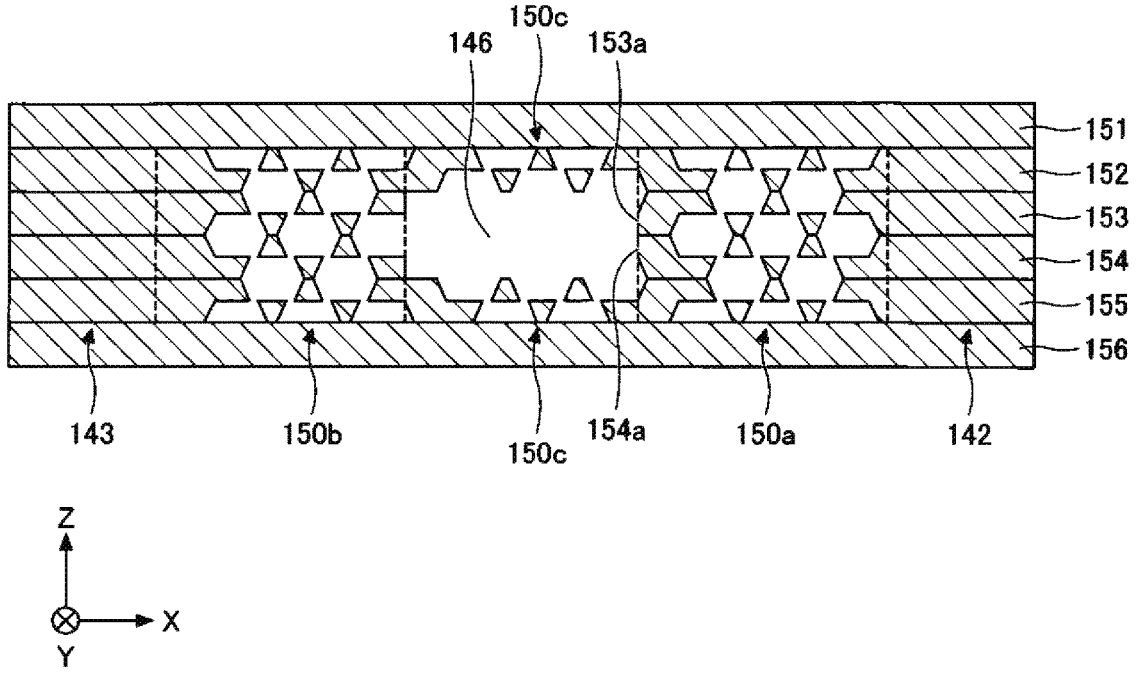

Next, a fifth embodiment will be described which is different from the first to fourth embodiments in that a porous body is also formed adjoining the outside pipe wall of the liquid pipe 140. FIGS. 14A and 14B are a partial schematic plan view and a sectional view taken along line I-I in FIG. 14A, respectively, showing an example internal structure of a liquid pipe 140 of a loop heat pipe according to the fifth embodiment. FIG. 14A is drawn in such a manner that the uppermost one of metal layers 151-156 shown in FIG. 14B is omitted.

In the first to fourth embodiments, the porous body 150 is formed so as to be in contact with, that is, is integrally formed with the inside pipe surface 142 of the liquid pipe 140 and the flow channel 146 is formed on the side of the outside pipe wall 143 of the liquid pipe 140. However, the invention is not limited to this case; the porous body may include a portion that is in contact with, that is, is integrally formed with the outside pipe wall 143.

As shown in FIGS. 14A and 14B, a porous body 150*a* (an example of "first porous body") is formed so as to be in contact with the inside pipe wall 142 of the liquid pipe 140. The porous body 150*a* has the same sectional structure as the above-described porous body 150. That is, as shown FIG. 14B, the porous body 150*a* is formed so as to span metal layers 152 to 155.

In the fifth embodiment, another porous body 150*b* (an example of "second porous body") is formed so as to be in contact with the outside pipe wall 143 of the liquid pipe 140. The porous body 150*b* is opposed to the porous body 150*a* and extends along the liquid pipe 140 from the condenser 120 to a position in the vicinity of the injection inlet 141. The porous body 150*b* has the same sectional structure as the above-described porous body 150. That is, as shown in FIG. 14B, the porous body 150*b* is formed so as to span the metal layers 152 to 155.

Furthermore, porous bodies 150*c* (an example of "third porous bodies") that connect the porous bodies 150*a* and 150*b* are formed between the end, on the side of the injection inlet 141, of the porous body 150*b* and the porous body 150*a*. As shown in FIG. 14B, the porous bodies 150*c* are formed in only part of the metal layers 152 to 155; for example, the porous bodies 150*c* are formed in only the respective metal layers 152 and 155 and openings 153*a* and 154*a* are formed in the respective metal layers 153 and 154. The porous bodies 150*c* are formed between the porous bodies 150*a* and 150*b*. One ends of the porous bodies 150*c* are connected to the porous body 150*a* and their other ends are connected to the porous body 150*b*.

A portion, between the porous bodies 150*c* and the condenser 120, of the flow channel 146 of the liquid pipe 140 is formed between the porous bodies 150*a* and 150*b*. In the region where the porous bodies 150*c* are formed, the opening 153*a* and 154*a* serve as the flow channel 146. A portion, between the porous bodies 150*c* and the evaporator 110, of the flow channel 146 of the liquid pipe 140 is formed between the porous body 150*a* and the outside pipe wall 143. As described above, also in the fifth embodiment, the flow channel 146 of the liquid pipe 140 is a space for guiding working fluid C to the evaporator 110.

Like the first embodiment, the above-described fifth embodiment can suppress a phenomenon that air bubbles remain after injection of working fluid C.

A modification is possible in which the porous body 150 is formed so as to extend from the condenser 120 to the evaporator 110 such that part of it is in contact with the outside pipe wall 143 while bypassing the injection inlet 141 as long as at least the porous body 150 is deviated to the side of the inside pipe wall 142 of the liquid pipe 140 and can guide liquid-phase working fluid C from the condenser 120 to the evaporator 110.

Although the preferred embodiments etc. have been described in detail, the invention is not limited to the above-described embodiments etc. and various modifications and replacements can be made in the above-described embodiments etc. without departing from the scope of the claims.

For example, bottomed holes may be formed in the metal layer 151 or 156 in the region where the porous body 150 is formed. Bottomed holes may be formed in a portion, exposed to the flow channel 146, of the metal layer 151 or 156. Forming bottomed holes also in the metal layer 151 or 156 makes it possible to enhance the heat transport performance even further.

Various aspects of the subject matter described herein are set out non-exhaustively in the following numbered clauses:

1) A manufacturing method of a loop heat pipe, the loop heat pipe comprising:

an evaporator configured to evaporate working fluid;

a condenser configured to condense the working fluid;

a liquid pipe which connects the evaporator and the condenser and has a first pipe wall and a second pipe wall which is opposed to the first pipe wall;

a porous body which is provided in the liquid pipe and is configured to guide the working fluid condensed by the condenser to the evaporator;

a flow channel which is a space that is formed in the liquid pipe and guides the working fluid condensed by the condenser to the evaporator; and a vapor pipe which connects the evaporator and the condenser and forms a loop together with the liquid pipe, the method comprising:

providing a plurality of metal layers; and stacking the plurality of metal layers on one another, providing each of the metal layers comprising:

proving a metal sheet;

forming bottomed holes in a top surface of the metal sheet;

forming bottomed holes in a bottom surface of the metal sheet; and forming an opening portion through the metal sheet, wherein:

the porous body includes the bottomed holes of each of the plural metal layers;

the flow channel is formed by the opening portions of the respective metal layers; and the porous body is disposed to be in contact with the first pipe wall.

What is claimed is:

1. A loop heat pipe comprising:

an evaporator configured to evaporate working fluid;

a condenser configured to condense the working fluid;

a liquid pipe which connects the evaporator and the condenser, the liquid pipe being formed by a plurality of metal layers stacked in a stacking direction, and the liquid pipe has a first pipe wall and a second pipe wall which is opposed to the first pipe wall in a direction orthogonal to the stacking direction of the plurality of metal layers;

a porous body which is provided in the liquid pipe and is configured to guide the working fluid condensed by the condenser to the evaporator, the porous body being formed of a plurality of stacked metal layers which are stacked in the stacking direction;

a flow channel which is a space that is formed in the liquid pipe and guides the working fluid condensed by the condenser to the evaporator; and a vapor pipe which connects the evaporator and the condenser and forms a loop together with the liquid pipe, wherein the porous body includes a first side edge in the direction orthogonal to the stacking direction, the first side edge is disposed to be in direct contact with the first pipe wall, and the porous body includes a second side edge opposite to the first side edge in the direction orthogonal to the stacking direction, the second side edge contacting the flow channel, and wherein all of the plurality of stacked metal layers forming the porous body are in direct contact with the first pipe wall at a position where the first side edge of the porous body directly contacts the first pipe wall.

2. The loop heat pipe according to claim 1, wherein the flow channel is disposed to be in contact with the second pipe wall.

3. The loop heat pipe according to claim 1, wherein the porous body is in contact with the first pipe wall over its full length.

4. The loop heat pipe according to claim 1, wherein the liquid pipe has an injection inlet which is connected to the second pipe wall and through which the working fluid is injected.

5. The loop heat pipe according to claim 1, wherein the porous body is integrally formed with the first pipe wall.

6. The loop heat pipe according to claim 1, wherein a surface of the second pipe wall is formed with at least one groove that communicates with the flow channel.

7. The loop heat pipe according to claim 6, wherein the groove extends in an extension direction of the liquid pipe.

8. The loop heat pipe according to claim 6, wherein each of the plurality of metal layers is formed with a groove.

9. The loop heat pipe according to claim 1, wherein the porous body comprises:

a first porous body which is disposed to be in contact with the first pipe wall; and a second porous body which is disposed to be opposed to the first porous body and to be in contact with the second pipe wall, and the flow channel is disposed between the first porous body and the second porous body.

10. The loop heat pipe according to claim 9, wherein the porous body further comprises a third porous body one end of which is connected to the first porous body and the other end of which is connected to the second porous body.

11. The loop heat pipe according to claim 1, wherein the plurality of stacked metal layers forming the porous body are respectively integrally formed with a corresponding plurality of the plurality of metal layers forming the liquid pipe.

* * * * *